US006648374B2

(12) United States Patent
Takemura

(10) Patent No.: US 6,648,374 B2
(45) Date of Patent: Nov. 18, 2003

(54) PRESENTATION DEVICES WITH INDEXED HOLDERS

(75) Inventor: Shun Takemura, Pacific Palisades, CA (US)

(73) Assignee: Itoya of America, Ltd., Torrance, CA (US)

( * ) Notice: Subject to any disclaimer, the term of this patent is extended or adjusted under 35 U.S.C. 154(b) by 235 days.

(21) Appl. No.: 10/035,548

(22) Filed: Oct. 16, 2001

(65) Prior Publication Data

US 2003/0071455 A1 Apr. 17, 2003

(51) Int. Cl.[7] ..... B42F 21/00

(52) U.S. Cl. ..... 283/36; 40/641; 283/38; 283/40; 283/42; 402/73; 402/79; 402/80 P; D19/26; D19/33

(58) Field of Search ..... 402/73, 79, 80 R, 402/80 L, 80 P, 500, 502; 283/36, 37, 38, 39, 40, 41, 42; D19/26, 27, 32, 33; 40/641

(56) References Cited

U.S. PATENT DOCUMENTS

| | | | | | |
|---|---|---|---|---|---|
| 2,599,768 | A | * | 6/1952 | Losch, Jr. | 402/79 |
| 3,315,684 | A | * | 4/1967 | Karl | 40/661 |
| 5,333,908 | A | * | 8/1994 | Dorney et al. | 283/38 |
| 5,806,894 | A | * | 9/1998 | Dottel | 281/38 |
| 6,012,866 | A | * | 1/2000 | Podosek | 402/79 |
| 6,106,018 | A | * | 8/2000 | McKeown et al. | 283/36 |
| 6,511,246 | B2 | * | 1/2003 | Sapienza et al. | 402/79 |
| 6,543,379 | B2 | * | 4/2003 | Schwartz | 116/234 |

* cited by examiner

*Primary Examiner*—Monica Carter
(74) *Attorney, Agent, or Firm*—Squire, Sanders & Dempsey, L.L.P.

(57) ABSTRACT

A folder, binder or book includes envelope pages with slits in the outer edges thereof so that the tabs of tabbed index cards, sized to fit snugly in the envelope pages can retain their tabs extending out through the slits. The index cards have cut off inner corners to allow easy insertion and removal.

20 Claims, 2 Drawing Sheets

PRESENTATION DEVICES WITH INDEXED HOLDERS

BACKGROUND OF THE INVENTION

Many different kinds of portfolios, binders, books, and folders exist, which hereinafter will be referred to generally as folders. Some well known types include three ring binders, spiral-bound notebooks and clasped folders. These are used to retain individual sheets, usually of paper, so that they can viewed as if they were bound in a book. Sometimes clear envelopes are included to retain and protect flat items for later display or study. These retained items typically include warranties, magazine clippings, reports and graphs, certificates, legal documents, photographs and negatives, collectible stamps and any other flat items including pressed flowers or other organic samples, where clear, usually plastic, envelopes can provide safe storage and display.

When viewing what is stored within such a folder, it is troublesome to find which of the pages include what material. Therefore, some folders, especially of the three ring type include index pages, usually of a relatively stiff material that have a tab that sticks out which when inserted between pages can indicate what is in the next section of the folder.

However, there has been a need for index means for folders which use when permanent binding is used or when indication of an exact page rather than an adjacent page is required Such devices, to be commercially viable must be extremely economical to produce, easily adaptable to existing folder constructions, light-weight, and constructed and installable so no interference with any of the normal functionality of a portfolio, binder, book, or folder occurs.

SUMMARY OF THE INVENTION

The present invention includes a plurality of transparent envelopes with a side connected to a folder cover, a bottom side usually completely closed or sealed, an open top which may have a protective flap and an outer side with a plurality of slits formed therein. The slits may be an odd or even number, but when the slits are greater than four in number, even numbers of slits are preferred as such minimize the number of different index card that need be furnished. These index cards are formed to fit snugly within the envelopes, but have at least one cutaway inner corner on the opposite side from their tab to make insertion of the index card into an envelope easy. The index cards include index tabs positioned on a side edge to slip through a slit to provide an index tab for the envelope. When three silts are used in the various envelopes, pluralities of two or three separately formed index cards are provided, usually in the back of the folder when it is sold where multiple index cards can be stored in the back envelope. When four slits are provided in each envelope, pluralities of two different index cards can be formed for insertion through the slits while when six slits are provided in each envelope, pluralities of three different index cards can be formed for insertion through the slits.

Therefore, it is an object of the present invention to provide a light and economical indexed folder for display of materials, which increases the utility of the folder, especially those equipped with transparent envelopes for the display of information on sheets that need to be indexed directly and held flat.

Another object is to provide a versatile index system for a folder or binder where the index tabs are firmly retained, yet movable by the owner.

Another object is to provide index means which can be constructed to have many vertical positions along the edge of a display page.

These and other objects and advantages of the present invention will become apparent to those skilled in the art after considering the following detailed specification and drawings wherein:

DETAILED DESCRIPTION OF THE SHOWN EMBODIMENTS

Figure 1:
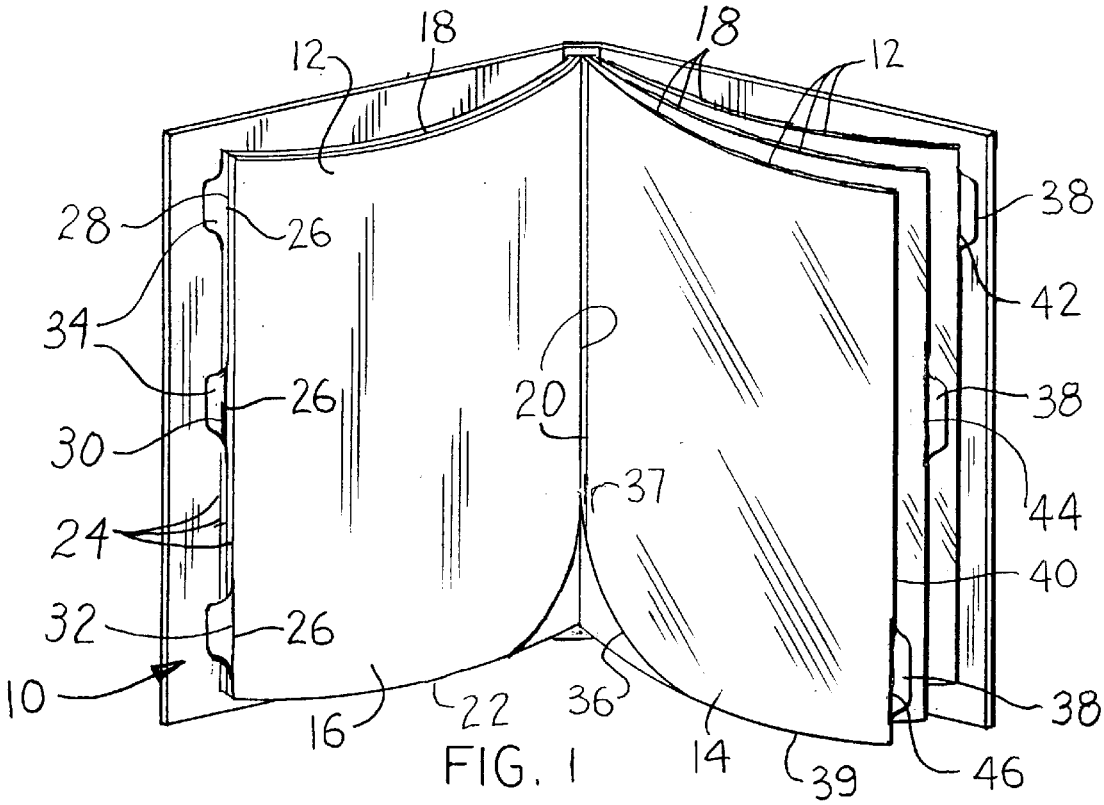
FIG. 1 is a perspective view of a partly open index folder constructed in accordance with the present invention.
Figure 2:
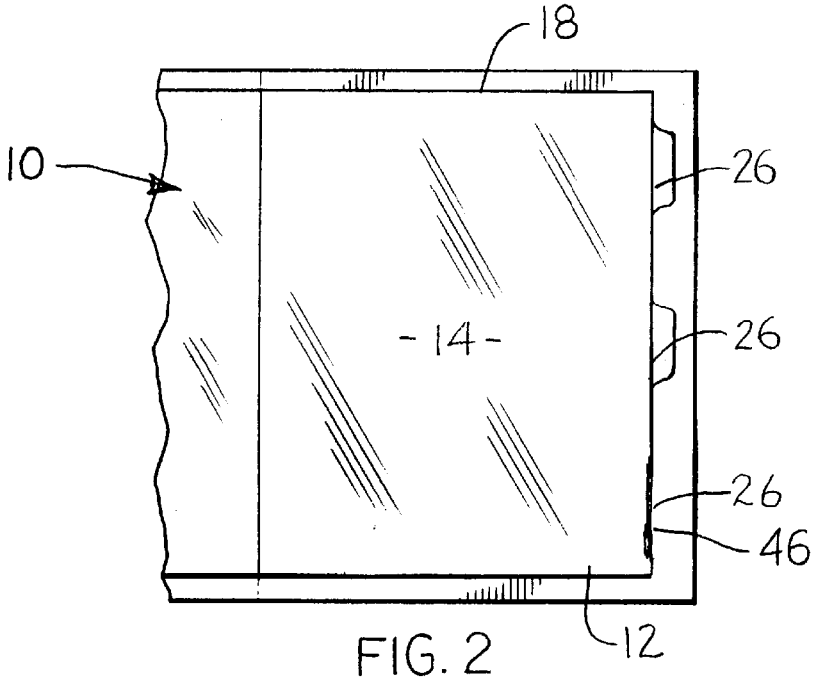
FIG. 2 is a partial front elevational view of the folder of FIG. 1 showing an envelope page that does not contain an index card.

Referring to the Figures more particularly by reference numbers, number 10 in FIG. 1 refers to a folder constructed in accordance with the present invention including a plurality of transparent envelope pages 12. Although the folder 10 is shown as having transparent pages 12 permanently bound therein, in fact the folder 10 may be a looseleaf binder, a spiral bound notebook, a conventionally bound book or similar structure. Each of the pages 12 in FIG. 1 include front and rear sheets 14 and 16 and a top edge 18 that is openable so that materials to be displayed can be inserted between the sheets 14 and 16 from the top. The inner edge 20 and the bottom edge 22 of the envelope page 12 is closed, usually by heat sealing or folding.

The outer edge 24 includes a plurality of slits 26, upper slit 28, central slit 30, and lower slit 32 being shown formed therein. The number of slits 26 may be odd or even, but when the slits 26 are greater in number than four, even numbers of slits 26 are preferred, as such minimize the number of different index cards 34 that need be furnished to the user when the user purchases the folder 10. The index cards 34 preferably are transparent so that a user can display a double sided sheet. These index cards 34 are formed to fit snugly within the envelope pages 12, but have at least one cutaway inner corner 36 on the opposite side 37 from their tab 38 and the bottom edge 39, to make for easy insertion of the index card 34 into an envelope page 12. The index cards 34 include index tabs 38 positioned on an outer side edge 40 to slip through a slit 26 to provide an index tab for the envelope page 12. Preferably, the tabs 38 have a length just smaller than the length of the slits 26.

Figure 3:
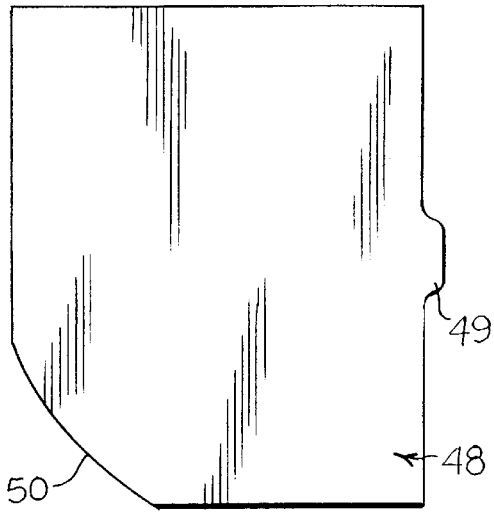
FIG. 3 is a side elevational view of an index card for the envelope page which can be inserted in either of two ways so that its tab can extend out of either an upper or lower slit of the envelope page.

When three slits 42, 44, and 46 are used in the various envelopes 12, pluralities of two or three separately formed index cards 34 with their tabs 38 in different positions are provided. As shown in FIG. 3, the index card 48 having a tab 49 for the central slit 44 has only one cutout inner corner 50.

Generally the index cards are more firmly retained if only one inner corner is cut away, but usually the convenience and versatility of having both corners cut out is more advantageous. When the folder 10 is sold, the index cards usually are positioned in an envelope page in the back of the folder 10 since all envelope pages 12 can receive any of the index cards 34.

Figure 5:
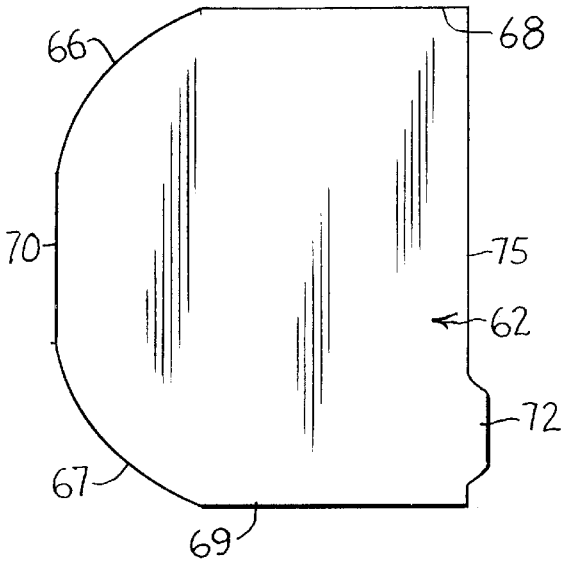
FIG. 5 is a side elevational view of an index card for the envelope page of FIG. 4 which has a tab that can be inserted out of the central slit of the envelope page and therefore only has one cutout corner.
Figure 4:
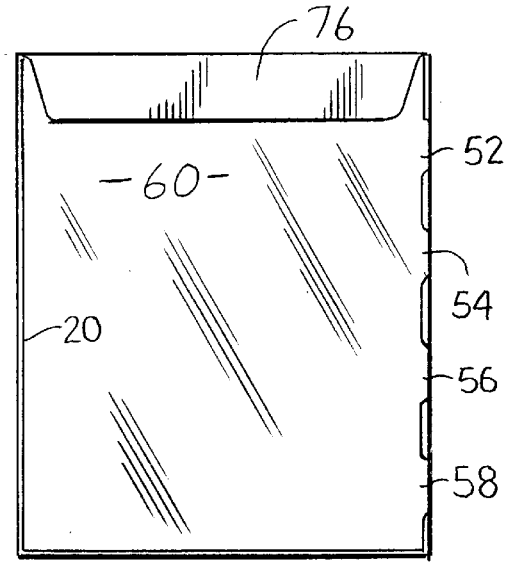
FIG. 4 is a side elevational view of a modified envelope page having four mirror image positioned slits through which a tab of one of two different types of index card can be inserted, the envelope page also including a fold over top cover.
Figure 6:
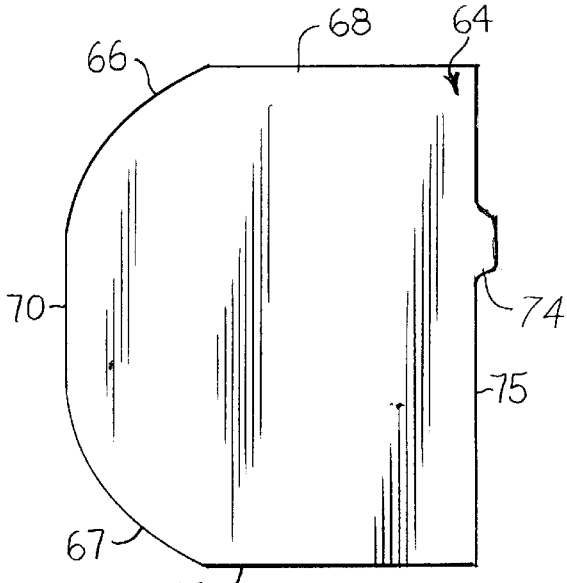
FIG. 6 is a side elevational view of a index card whose tab can be positioned in either the upper or lower inner slit of the modified envelope page of FIG. 4.

As shown in FIG. 4, when four slits 52, 54, 56, and 58 are provided in each envelope page 60, pluralities of two different index cards 62 and 64, as shown in FIGS. 5 and 6, with both inner corners having cutouts 66 and 67 extending from the upper and lower edges 68 and 69 respectively, to a central portion 70 are provided. The central portion 70 between the cutouts 66 and 68 fits snugly against the inner edge 20 of the envelope page 60 and assures that the tab 72 or 74, which extends from the opposite edge 75, remains in its slit. Note that the envelope page 60 includes a optional folder over flap 76 to retain display sheets more securely, especially if the folder 10 is held upside down.

Thus, there has been shown and described indexed presentation display folders which fulfill all of the objects and advantages sought therefore. Many changes, alterations, modifications, and other uses and applications of the subject invention, become apparent to those skilled in the art after considering the specification together with the accompanying drawings. All such changes, alterations, and modifications which do not depart from the spirit and scope of invention are deemed to be covered by the invention, which is limited only by the claims that follow.

What is claimed is:

1. An indexed display device comprising:

a protector for holding generally planar displays having:
- a generally planar front cover;
- a generally planar rear cover;
- means for connecting said generally planar front and rear covers together;

a plurality of envelopes, each having:
- a closed first edge attached at a first said means for connecting said generally planar front and rear covers together;
- a closed second edge opposite said first edge;
- a closed third edge perpendicular to said first edge; and
- an openable fourth edge, said closed second edge including:
  - at least one slit therein positioned spaced from said third and fourth edges; and at least one planar index member in positionable in one of said envelopes, said at least one index planar member including:
- a first index edge positionable adjacent said closed first edge;
- a second index edge positionable adjacent said closed second edge having:
  - an index tab positioned along said second index edge for insertion through said slit and out of said envelope; and
  - a third index edge extending between said first and second index edges, said third index edge having:
    - a first portion for resting on said closed third edge; and
    - a second portion curved away from said closed third edge when said first portion is resting on said closed third edge.

2. The indexed display device as defined in claim 1 wherein said second portion curved away from said closed third edge when said first portion is resting on said closed third edge extends to said first index edge.

3. The indexed display device as defined in claim 1 wherein said closed second edge includes:

at least two slits therein positioned spaced generally equal distances from said third and fourth edges.

4. The indexed display device as defined in claim 1 wherein said envelopes are transparent.

5. The indexed display device as defined in claim 1 wherein said first and second index edges are spaced apart so as to fit snugly between said closed first and second edges when positioned in an envelope.

6. The indexed display device as defined in claim 1 wherein said closed second edge includes:

at least three slits therein, two of said slits being positioned spaced generally equal distances from said third and fourth edges and one of said slits being spaced between said other two slits.

7. The indexed display device as defined in claim 1 wherein said second edge includes:

at least first, second, and third slits therein, said first and third slits being positioned spaced generally equal distances from said third and fourth edges and said second slit being spaced between said first and third slits, and wherein at least one planar index member includes:
- a first planar index member having:
  - an index tab positioned along said second index edge for insertion through said first or third slit and out of said envelope; and
- a second planar index member having:
  - an index tab positioned along said second index edge for insertion through said second slit and out of said envelope.

8. The indexed display device as defined in claim 7 wherein said first planar index member includes:

a fourth index edge extending between said first and second index edges, said fourth index edge having:
- a first portion for resting on said closed third edge; and
- a second portion curved away from said closed third edge when said first portion is resting on said closed third edge.

9. An indexed display device comprising:

a protector for holding generally planar displays;

a plurality of envelopes, each having:
- a closed first edge attached to said protector;
- a closed second edge opposite said first edge;
- a closed third edge perpendicular to said first edge; and
- an openable fourth edge, said closed second edge including:
  - at least one slit therein positioned spaced from said third and fourth edges; and a plurality of index members positioned in said envelopes, each of said index members including:
- a first index edge positioned adjacent said closed first edge of said envelope in which said index member is positioned;
- a second index edge positionable adjacent said closed second edge of said envelope in which said index member is positioned having:
  - an index tab positioned along said second index edge of said envelope in which said index member is positioned for insertion through said slit and out of said envelope; and
- a third index edge extending between said first and second index edges, said third index edge having:
  - a first portion for resting on said closed third edge of said envelope in which said index member is positioned; and a second portion curved away from said closed third edge when said first portion is resting on said closed third edge.

10. The indexed display device as defined in claim 9 wherein said second portion curved away from said closed third edge when said first portion is resting on said closed third edge extends to said first index edge.

11. The indexed display device as defined in claim 9 wherein said closed second edge includes:

at least two slits therein positioned spaced generally equal distances from said third and fourth edges.

12. The indexed display device as defined in claim 9 wherein said envelopes are transparent.

13. The indexed display device as defined in claim 9 wherein said first and second index edges are spaced apart so as to fit snugly between said closed first and second edges of said envelope in which said index member is positioned.

14. The indexed display device as defined in claim 9 wherein said closed second edge includes:

at least three slits therein, two of said slits being positioned spaced generally equal distances from said third and fourth edges and one of said slits being spaced between said other two slits.

15. The indexed display device as defined in claim 9 wherein said closed second edge includes:

at least first, second, and third slits therein, said first and third slits being positioned spaced generally equal distances from said third and fourth edges and said second slit being spaced between said first and third slits, and wherein at least one index member includes:

a first index member having:

an index tab positioned along said second index edge for insertion through said first or third slit and out of said envelope; and a second index member having:

an index tab positioned along said second index edge for insertion through said second slit and out of said envelope.

16. The indexed display device as defined in claim 15 wherein said first index member includes:

a fourth index edge extending between said first and second index edges, said fourth index edge having:

a first portion for resting on said closed third edge; and a second portion curved away from said closed third edge when said first portion is resting on said closed third edge.

17. An indexed display device comprising:

a protector for holding generally planar displays;

a plurality of envelopes, each having:

a first edge attached to said protector;

a second edge opposite said first edge;

a third edge perpendicular to said first edge; and an openable fourth edge, said second edge including:

at least one slit therein positioned spaced from said third and fourth edges; and a plurality of index members positioned in said envelopes, each of said index members including:

a first index edge positioned adjacent said first edge of said envelope in which said index member is positioned;

a second index edge positionable adjacent said second edge of said envelope in which said index member is positioned having:

an index tab positioned along said second index edge of said envelope in which said index member is positioned for insertion through a slit of said at least one slit and out of said envelope; and a third index edge extending between said first and second index edges, said third index edge having:

a first portion for resting on said third edge of said envelope in which said index member is positioned; and a second portion spaced away from said third edge when said first portion is resting on said third edge.

18. The indexed display device as defined in claim 17 wherein said second edge includes:

at least first, second, and third slits therein, said first and third slits being positioned spaced generally equal distances from said third and fourth edges and said second slit being spaced between said first and third slits, and wherein at least one index member includes:

a first index member having:

an index tab positioned along said second index edge for insertion through said first or third slit and out of said envelope; and a second index member having:

an index tab positioned along said second index edge for insertion through said second slit and out of said envelope.

19. The indexed display device as defined in claim 18 wherein said first index member includes:

a fourth index edge extending between said first and second index edges, said fourth index edge having:

a first portion for resting on said closed third edge; and a second portion spaced away from said closed third edge when said first portion is resting on said closed third edge.

20. The indexed display device as defined in claim 17 wherein said second portion spaced away from said closed third edge when said first portion is resting on said closed third edge extends to said first index edge.

* * * * *